US007249916B2

(12) United States Patent
Klyne

(10) Patent No.: US 7,249,916 B2
(45) Date of Patent: Jul. 31, 2007

(54) METHOD OF SITE PREPARATION IN ENVIRONMENTALLY SENSITIVE AREAS

(75) Inventor: Albert Allen Klyne, Enoch (CA)

(73) Assignee: Ecoroads Holdings Ltd., Calgary, Alberta (CA)

( * ) Notice: Subject to any disclaimer, the term of this patent is extended or adjusted under 35 U.S.C. 154(b) by 0 days.

(21) Appl. No.: 11/385,614

(22) Filed: Mar. 21, 2006

(65) Prior Publication Data

US 2006/0216120 A1 Sep. 28, 2006

(30) Foreign Application Priority Data

Mar. 22, 2005 (CA) ..... 2501773

(51) Int. Cl.
*E02D 3/00* (2006.01)

(52) U.S. Cl. ..... 405/302.4; 405/302.6

(58) Field of Classification Search ..... 405/302.4, 405/302.6

See application file for complete search history.

(56) References Cited

U.S. PATENT DOCUMENTS 4,433,813 A * 2/1984 Whatton et al. ..... 404/71

4,830,532 A * 5/1989 Macke et al. ..... 405/302.4

OTHER PUBLICATIONS

King County 'Shredded Wood-Waste and Landscape Mulch', May 11, 2005, available at http://www.metrokc.gov/procure/green/hogfuel.htm, Maple Valley, WA, as early as May 11, 2005.

Sustainable Business CD Library: *Cleaner Production Intrnational, L.L.C.*, htty://www.cleanerproduction.com/hits/CDlibrary.htm (web page) re: Cleaner Production, Pollution Prevention and Sustaniable Business, 56 pp.

* cited by examiner

*Primary Examiner*—Frederick L. Lagman
(74) *Attorney, Agent, or Firm*—Davis Bujold & Daniels, P.L.L.C.

(57) ABSTRACT

A method of site preparation in environmentally sensitive areas. A first step involves determining boundaries of a site. A second step involves removing obstacles, if any, from within the boundaries of the site. A third step involves laying a layer of interlocking wood fibre on the site. A fourth step involves packing down the layer to form a cohesive ground cover mat. The steps of laying a layer of interlocking wood fibre on the site and packing down the layer is repeated to increase a thickness of the cohesive ground cover mat, until a hard packed base of at least six inches in depth has been formed.

1 Claim, 2 Drawing Sheets

METHOD OF SITE PREPARATION IN ENVIRONMENTALLY SENSITIVE AREAS

FIELD OF THE INVENTION

The present invention relates to a method of site preparation in environmentally sensitive areas, such as site preparation for oil and gas drilling.

BACKGROUND OF THE INVENTION

It is preferable to minimize environmental damage when working in environmentally sensitive areas. The oil and gas drilling is an example of an application in which a temporary site access is required. An example of environmentally sensitive areas are public wilderness park lands or private farm lands. Drilling permits are refused on public wilderness park lands, unless stringent conditions are met to protect the environment. Private farm lands must be restored to their former use. The greater the environmental damage caused during the drilling operations, the more expensive it becomes to restore the lands to their former use as farm lands.

SUMMARY OF THE INVENTION

According to the present invention there is provided a method of site preparation in environmentally sensitive areas. A first step involves determining boundaries of a site. A second step involves removing obstacles, if any, from within the boundaries of the site. A third step involves laying a layer of interlocking wood fibre on the site. A fourth step involves packing down the layer to form a cohesive ground cover mat. The steps of laying a layer of interlocking wood fibre on the site and packing down the layer is repeated to increase a thickness of the cohesive ground cover mat, until a hard packed base of at least six inches in depth has been formed.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

FIG. 5 is a side elevation view of wood fibre being disposed of.

DETAILED DESCRIPTION OF THE PREFERRED EMBODIMENT

Figure 1:
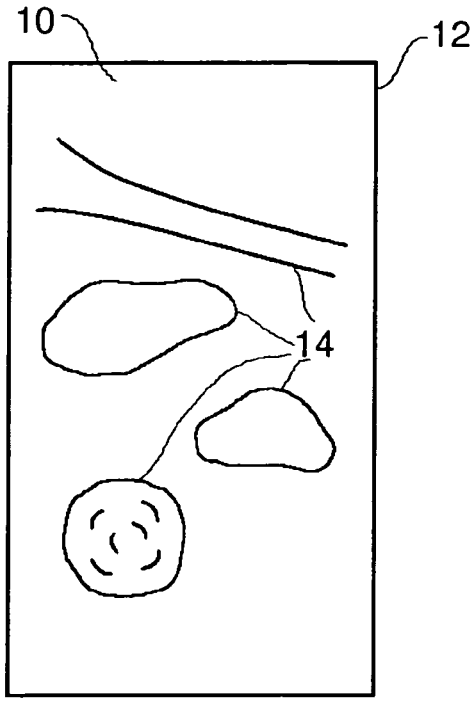
FIG. 1 is a top plan view of a site with obstacles.

The preferred embodiment, a method of site preparation in environmentally sensitive areas generally identified by reference numeral 10, will now be described with reference to FIG. 1 through 4.

Figure 2:
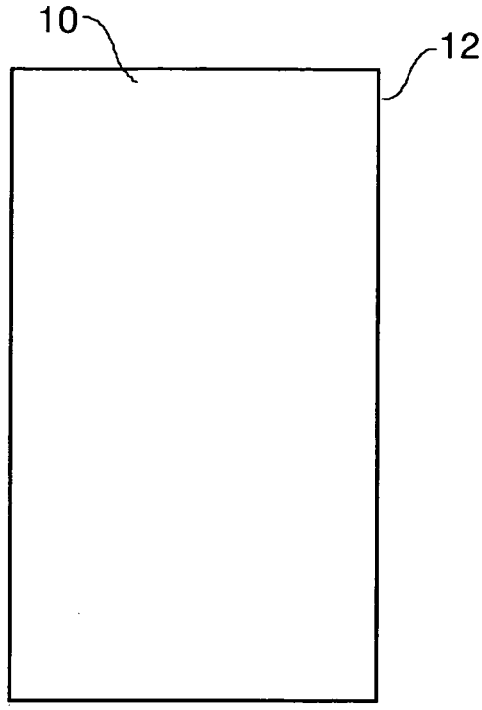
FIG. 2 is a top plan view of the site in FIG. 1 with the obstacles removed.
Figure 3:
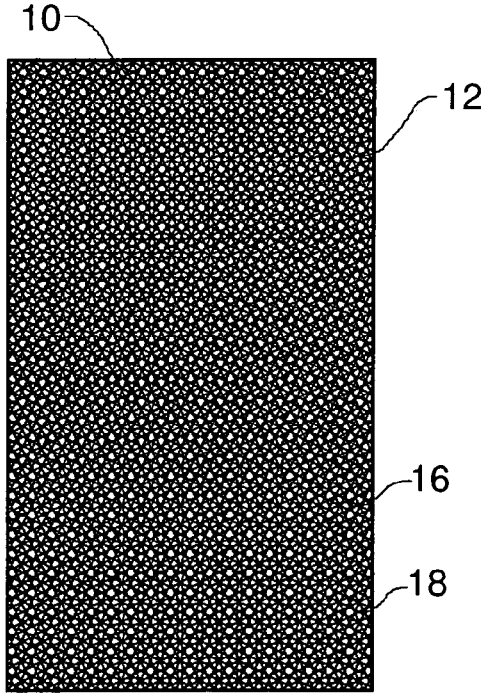
FIG. 3 is a top plan view of the site in FIG. 1 with a layer of interlocking wood fibre.
Figure 4:
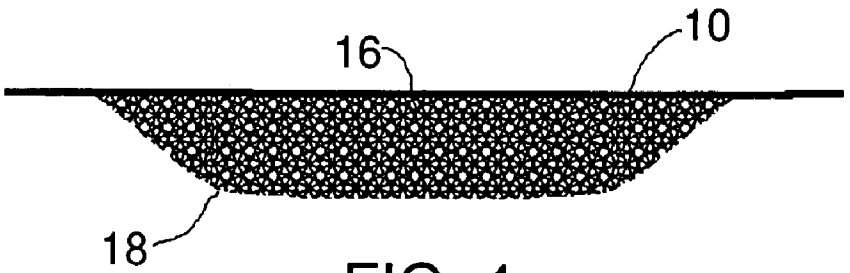
FIG. 4 is an end view in section of a ground cover mat.

Referring to FIG. 1 there is shown environmentally sensitive area 10. The site is to be prepared for use, such as for temporary access. The first step is to determine boundaries 12 for site 10. Any obstacles 14 present within boundaries 12 of the 10 are removed, as shown in FIG. 2. Referring to FIG. 3, the next step is to lay a layer of interlocking wood fibre 16 on site 10. Layer 16 is packed down to form a cohesive ground cover mat 18. Referring to FIG. 4, the steps of laying a layer of interlocking wood fibre 16 on site 10 and packing down layer 16 are repeated to increase a thickness of cohesive ground cover mat 18, until a hard packed base of at least six inches in depth has been formed.

It has been found that a cohesive ground cover mat 18 can be achieved by using interlocking wood fibre that includes at least 20% by volume of medium length elongate wood fibre of a length of not less than 2 inches and not more than 5 inches, not more than 10% by volume of long length elongate wood fibre of a length of greater than 5 inches, and a balance of short length wood, fibre of a length of less than 2 inches.

Figure 5:
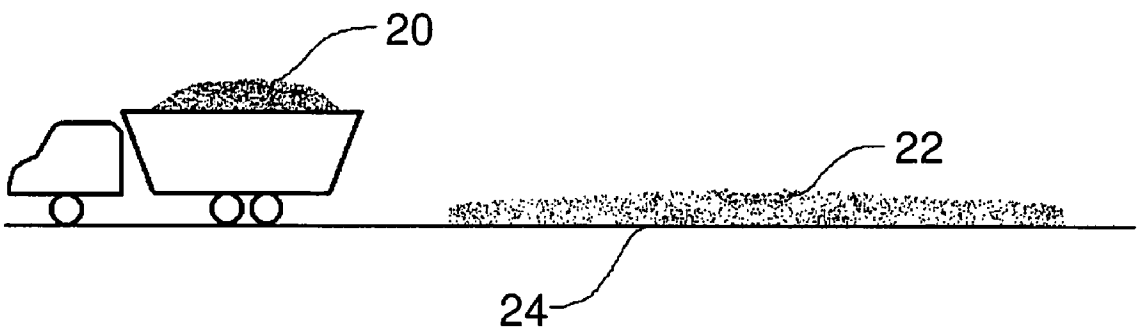

Referring to FIG. 5, once the ground cover mat 18 is no longer desired at site 10, site restoration can be accomplished by removing from site 10 any contaminated wood fibre 20 for disposal, and scattering uncontaminated wood fibre 22 on lands 24 surrounding site 10. Uncontaminated wood fibre 22 should be scattered sufficiently that they will break down and decompose over a reasonable, time by natural processes.

It is envisaged that ground cover mat 18 formed by this method will be between six inches and twenty-four inches thick. The thickness required for any given site will depend upon the nature of the underlying soil and flora. In rocky soil conditions, the underlying soil can support weight and a ground cover mat of as little as six inches will be sufficient. In wet spongy ground conditions, a layer of approximately twenty-four inches will be required to support equipment and prevent environmental damage.

Advantages:

The present method provides a number of advantages over other methods of site preparation. The layers of wood fibre will eliminate mud problems. The layers of wood fibre will eliminate any need for removal of top soil during preparation; the existing flora is merely covered. Should a minor oil spill occur, the wood fibre will absorb the oil and prevent it from reaching the underlying flora. Site restoration is accomplished by merely removing wood fibre which have become contaminated and scattering wood fibre which are uncontaminated so that they will decompose over time through natural processes. A further advantage is gained from the insulating properties of the multiple layers of wood fibre. In many areas of the Canada, drilling activities can only be conducted as long as the ground is frozen. It is believed that the insulating properties of the multiple layers of wood fibre will enable the drilling "season" to be extended on average by between two and four months. The economic impact of the lengthening of the drilling season is huge. In the Canadian arctic, it is believed that the use of this site preparation method could enable drilling programs to continue year round, as the insulating properties of the wood fibre will maintain the permafrost in a permanently frozen state.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of site preparation in environmentally sensitive areas, the method comprising the steps of:

determining boundaries of a site in an environmentally sensitive area that is to be used as a work site with minimal disturbance of soil and flora and then restored to its original condition;

removing obstacles, if any, from within the boundaries of the site;

laying a layer of interlocking wood fibre on the site, the interlocking wood fiber including:

at least 20% by volume of medium length elongate wood fiber of a length of not less than 2 inches and not more than 5 inches;

not more than 10% by volume of long length elongate wood fiber of a length of greater than 5 inches;

a balance of short length wood fiber of a length of less than 2 inches;

packing down the layer to form a cohesive ground cover mat over soil and flora; and repeating the steps of laying a layer of interlocking wood fibre on the site and packing down the layer to increase a thickness of the cohesive ground cover mat, until a hard packed base of at least six inches in depth has been formed; and restoring the site by removing from the site for disposal any contaminated wood fiber and scattering uncontaminated wood fiber on lands surrounding the site, the uncontaminated wood fiber being scattered sufficiently that they will break down and decompose over a reasonable time by natural processes.

* * * * *